US006092988A

United States Patent [19]

Botros

[11] Patent Number: 6,092,988

[45] Date of Patent: Jul. 25, 2000

[54] CENTRIFUGAL BLOWER ASSEMBLY WITH A PRE-SWIRLER FOR AN AUTOMOTIVE VEHICLE

[75] Inventor: Monier Bibawy Botros, Troy, Mich.

[73] Assignee: Ford Motor Company, Dearborn, Mich.

[21] Appl. No.: 09/110,275

[22] Filed: Jul. 6, 1998

[51] Int. Cl.[7] ..... F01D 1/02

[52] U.S. Cl. ..... 415/191; 415/206; 415/208.2

[58] Field of Search ..... 415/119, 208.2, 415/211.1, 185, 191, 192, 206

[56] References Cited

U.S. PATENT DOCUMENTS

| | | |
|---|---|---|
| 654,654 | 7/1900 | Lawrence . |
| 2,570,155 | 10/1951 | Redding . |
| 2,727,680 | 12/1955 | Madison et al. . |
| 2,834,536 | 5/1958 | McDonald . |
| 3,096,080 | 7/1963 | Willems . |
| 3,583,827 | 6/1971 | Wood . |
| 3,781,127 | 12/1973 | Wood . |
| 3,782,851 | 1/1974 | Hackbarth et al. . |
| 4,021,135 | 5/1977 | Pedersen et al. . |
| 4,177,007 | 12/1979 | Schlangen et al. . |
| 4,208,167 | 6/1980 | Yasugahira et al. . |
| 4,566,852 | 1/1986 | Hauser . |
| 4,917,572 | 4/1990 | Van Houten . |
| 4,946,348 | 8/1990 | Yapp . |
| 5,183,382 | 2/1993 | Carroll . |
| 5,215,437 | 6/1993 | TeVelde et al. . |
| 5,951,245 | 9/1999 | Sulivan ..... 415/192 |

FOREIGN PATENT DOCUMENTS

| | | |
|---|---|---|
| 192 760 | 2/1923 | United Kingdom . |
| 1 502 781 | 10/1975 | United Kingdom . |
| 91/15664 | 10/1991 | WIPO ..... 415/208.2 |

*Primary Examiner*—Edward K. Look
*Assistant Examiner*—Rhonda Barton
*Attorney, Agent, or Firm*—Raymond L. Coppielle

[57] ABSTRACT

A centrifugal blower assembly is disclosed. The blower assembly includes a centrifugal fan driven by an electric motor. The blower assembly housing includes a pre-swirler having a plurality of guide vanes which impart a predetermined amount of rotation to a volume of air as the air enters the centrifugal blower assembly. The guide vanes are disposed in a ring at the air inlet of the blower housing.

16 Claims, 3 Drawing Sheets

CENTRIFUGAL BLOWER ASSEMBLY WITH A PRE-SWIRLER FOR AN AUTOMOTIVE VEHICLE

BACKGROUND OF THE INVENTION

1. Field of the Invention

The present invention relates generally to centrifugal blower assemblies for automotive vehicles. More particularly, the present invention relates to a centrifugal blower assembly having an apparatus for rotating a volume of air entering the assembly.

2. Background Information

Centrifugal blowers and fans generally include an impeller or blower wheel that rotates in a predetermined direction in a housing and which may be driven by an electric motor. The impeller has curved blades which draw air in axially, along the impellers' axis of rotation, and discharge air radially outwardly. Such blowers are used in a variety of applications, such as in heating and cooling systems, especially for automotive applications.

Centrifugal fans have been fitted with well known shutter devices to reduce the opening of the air passage formed through the fan casing to control the capacity of the fan. The shutter arrangement can be closed to provide adequate airflow adjustment while, at the same time, reducing the horsepower requirements of the fan. However, with these type of shutter arrangements, fan pulsations can occur when the air passage opening is partially closed. In those cases where the shutters are opened fully, the incoming air impinging on the impeller blades often results in a substantial amount of boundary layer flow separation due to the angle with which the incoming air contacts the leading edge of the impeller blades. This separation can result in increasing noise, vibration, and harshness as well as degrading the efficiency of the centrifugal blower.

In addition, as the air approaches the blower or fan inlet opening in an axial direction, it tends to reach the middle and lower portions of the blower fan wheel or impeller and flows radially outwardly to the blower housing scroll more from the middle portion of the wheel. Less air blows from the top portion of the impeller and therefore, the fan is inefficient.

To overcome the above-described problems, U.S. Pat. No. 3,781,127 discloses a centrifugal blower which includes a plurality of spin inducing inlet vanes and a mechanism for pivotably supporting the vanes around the outer wall of the inlet to the centrifugal blower. With this arrangement, the capacity or amount of air entering the blower can be controlled and a spin can be imparted to the incoming gas. Alternatively, the vanes can be shut completely, restricting the flow of gas into the blower while imparting a maximum spin to the incoming gas. The system of the '127 patent is attached to a position outside of the housing of the blower.

Each vane of the assembly '127 can pivot to vary the amount of opening to the air entering the fan blower. However, the assembly is costly and complex to manufacture. Furthermore, the assembly needs a mechanism to control the amount of rotation or pivot of each of the blades relative to the blower housing, adding further cost and complexity to the centrifugal blower. Also, the amount of spin imparted by the moveable blades is insufficient to overcome or reduce the boundary layer flow separation around each of the blades of the centrifugal blower. Therefore, it would be advantageous to provide a less expensive and less complicated device which reduces the flow separation around each of the blades of the centrifugal blower impeller, forces incoming air to flow through the entire fan/impeller wheel and improves the efficiency of the blower while reducing the axial force exerted by the gas on the fan hub.

SUMMARY OF THE INVENTION

The problems associated with the prior art are overcome by the present invention which provides a centrifugal blower assembly. The blower assembly comprises a fan wheel having a plurality of fan blades disposed between a fan ring and a fan hub and a motor having a rotating shaft projecting therefrom and which engages the fan hub, the motor rotating the fan wheel about an axis coincident with the axis of the rotating shaft. The assembly also includes a housing for receiving the fan wheel and motor therein, the housing having an air inlet side, a motor receiving side opposite the air inlet side and a generally curved wall extending between the air inlet side and motor receiving side and thereby defining a chamber through which a volume of air passes. The air inlet side of the housing includes a generally circular inlet ring having a predetermined axial length and defining an inlet aperture through which air is drawn by rotation of the fan wheel. The air inlet side further includes a generally circular inner ring disposed a predetermined distance radially inwardly from the inlet ring as well as a plurality of stationary guide vanes disposed between the inner ring and the inlet ring generally parallel to the axis of rotation of the fan wheel. The plurality of guide vanes each has a predetermined axial length extending axially below the axial length of the inlet ring and includes a constant inlet angle and a variable exit angle along a trailing edge of the guide vanes.

The present invention provides the advantage that a stationary, moldable device can impart a spin to a volume of air entering a centrifugal blower, causing the air to impinge upon the full axial length of the blades of the blower wheel in such a way to increase the amount of air entering the top of the blower wheel as well as reduce or eliminate boundary layer flow separation as the air flows over the blades. This increases the efficiency of the centrifugal blower while reducing cost, noise, vibration and harshness. These and other advantages of the present invention will become apparent from the drawings, detailed description and claims which follow.

DETAILED DESCRIPTION OF THE PREFERRED EMBODIMENTS

Figure 1:
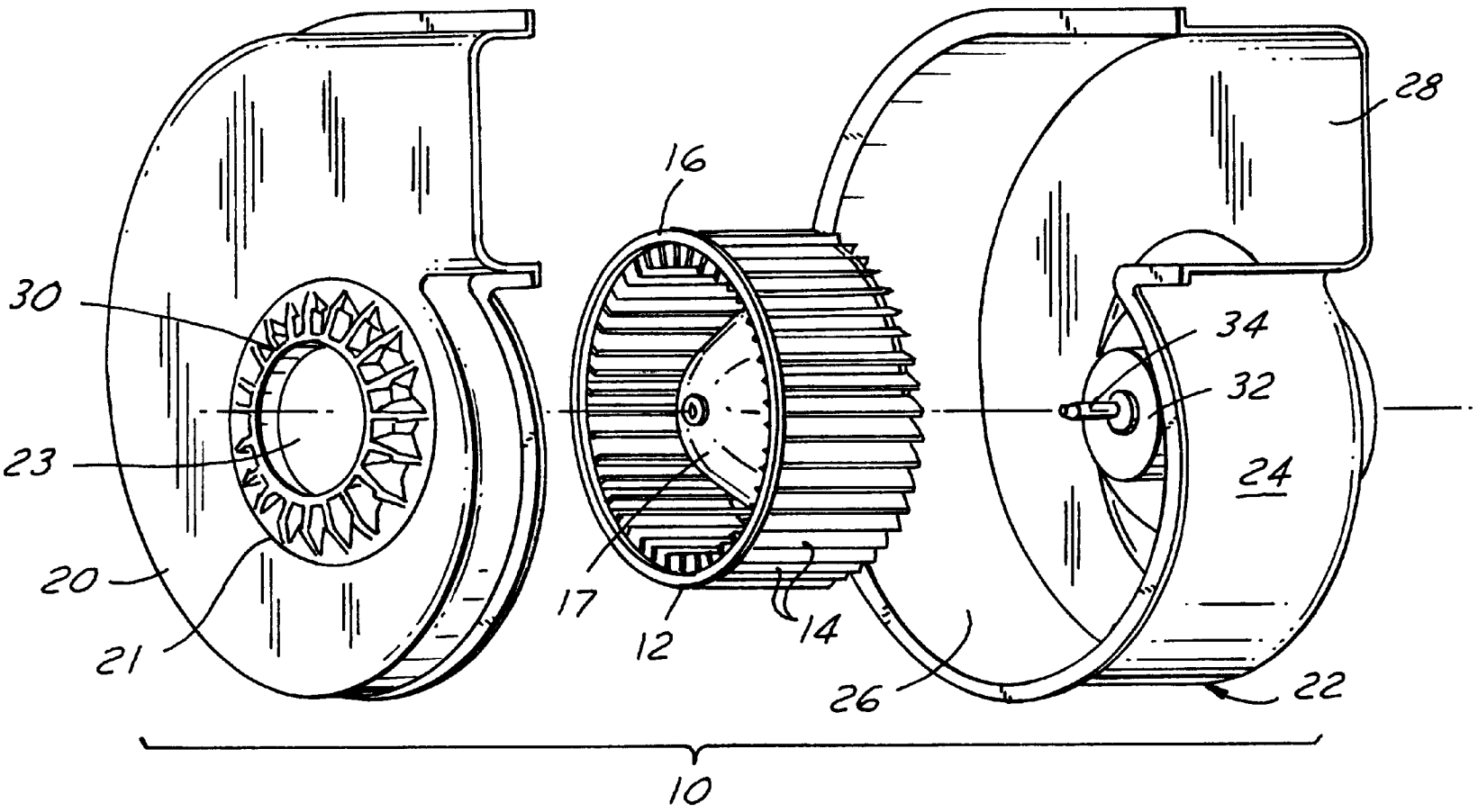
FIG. 1 is an exploded, perspective view of a centrifugal blower/fan assembly structured in accord with the principles of the present invention.

Referring now to the drawings, FIG. 1 shows a centrifugal blower/fan assembly according to the present invention. The centrifugal blower assembly 10 includes a fan wheel 12 having a plurality of fan blades 14 disposed around a fan inlet ring 16 and a hub 17 of the fan wheel. The fan wheel 12 is disposed within a housing 18 defined by two cover pieces, a left or inlet housing side 20 and a right or motor receiving side 22 disposed opposite therefrom. The housing 18 further includes a generally curved wall 24 extending between the inlet side 20 and motor side 22. The inlet housing cover 20 includes a generally circular inlet ring 21 forming an aperture 23 through which a volume of air is drawn by the fan wheel 12 to provide a volume of air through different heating, ventilation, and air conditioning components found within a plenum of an automotive vehicle. The inlet side 20, motor side 22, and wall 24 cooperate to define an airflow passage volume 26 and an exit end 28 through which the air passes into or toward the heating, ventilation, and air conditioning components in the plenum. The centrifugal blower assembly 10 of the present invention further includes a pre-swirler 30 which is disposed within the inlet aperture 23 to impart a spin or rotation onto a volume of air passing between its vanes before entering into the centrifugal blower assembly 10. The pre-swirler 30 will be described in much greater detail below. The centrifugal blower assembly further includes a motor 32 having a shaft 34 which engages the centrifugal fan 12 to cause the fan to spin, thus drawing air in through the inlet aperture 23 of the housing around the airflow passage 26 and through the outlet end 28 of the centrifugal blower assembly.

Figure 2:
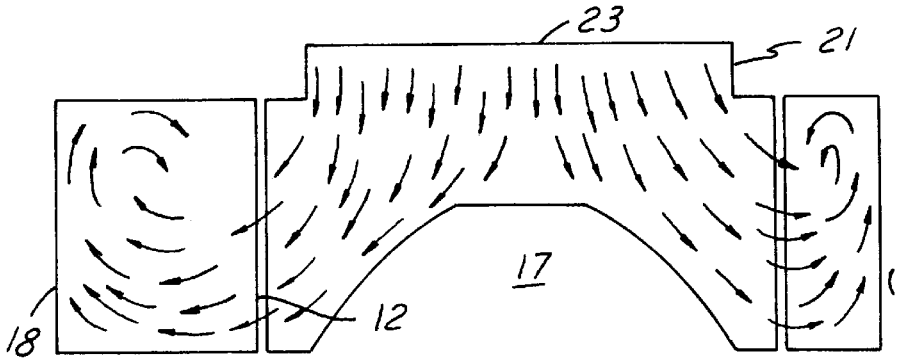
(PRIOR ART) FIG.2
FIG. 2 is a velocity vector diagram for a centrifugal blower housing assembly without an apparatus according to the present invention.
Figure 3:
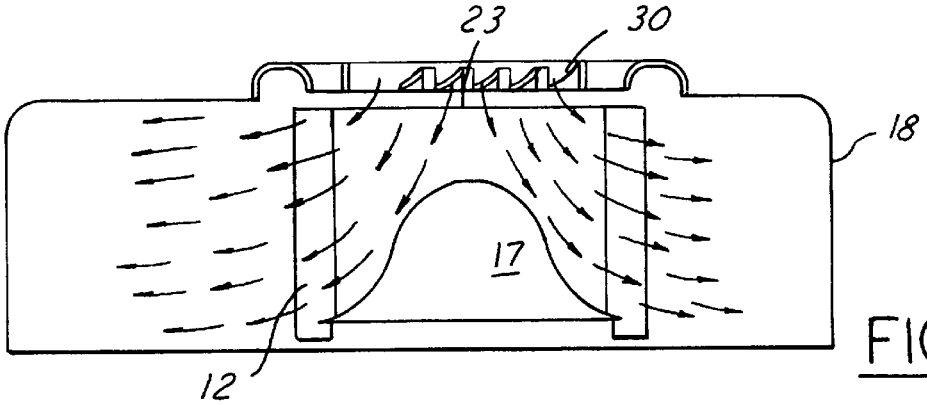
FIG. 3 is a velocity vector diagram for a centrifugal blower structured in accord with the principles of the present invention.

FIGS. 2 and 3 show the effect that the pre-swirler 30 of the present invention has on the airflow entering the centrifugal blower assembly 10. FIG. 2 is a velocity vector diagram of a typical centrifugal blower assembly without a pre-swirler or other apparatus for imparting a rotation or a spin onto a volume of air prior to the air entering the centrifugal fan. In FIG. 2 the blower housing 18 of the assembly 10 is shown in profile. The housing 18 includes an inlet aperture or opening 23. The arrows in the diagram represent the airflow and as the air approaches the opening in an axial direction, it tends to reach the middle and lower portions of the blower fan and flows radially outwardly to the blower housing more from the middle and lower portions of the fan. The radial velocity of the fan wheel is responsible for the airflow rate that the blower delivers. For this reason, less air is flowing through the top portion of the blower fan and the blower is inefficient. The arrows indicate that an upward rotation of air is caused by the longer radial velocity component in the middle portion of the fan wheel, combined with an axial component towards the backside 22. Undesirable energy losses and noise is also produced as is uneven wear of the fan hub because of the uneven pressure imposed the axial length of the fan wheel.

By contrast, FIG. 3 shows the velocity vector diagram for a volume of air entering the blower assembly through the opening having a pre-swirler molded therein. As the air enters and passes through the pre-swirler 30, the vanes of the pre-swirler cause the air to rotate, giving the air a desirable tangential velocity component to correct the air relative motion with respect to the fan blade inlet edge. This in turn reduces or eliminates the separation from the suction side of the fan blades. More air is directed in this fashion to the top portion of the blower wheel, and the radial velocity of the air is increased, to the level of the middle portion of the fan blades, by the design of the guide vanes of the pre-swirler as will be explained more fully below. The increased velocity of the air at this upper portion prevents the air flow from rotating upwardly in the housing. This increases the overall efficiency of the centrifugal fan 12 and blower assembly 10, resulting in less power needed to drive the fan for an equivalent amount of air to flow through assembly 10. Furthermore, since the airflow separation area is not formed at the suction side of the fan blades, noise, vibration and harshness are less likely to develop within the assembly.

Figure 4:
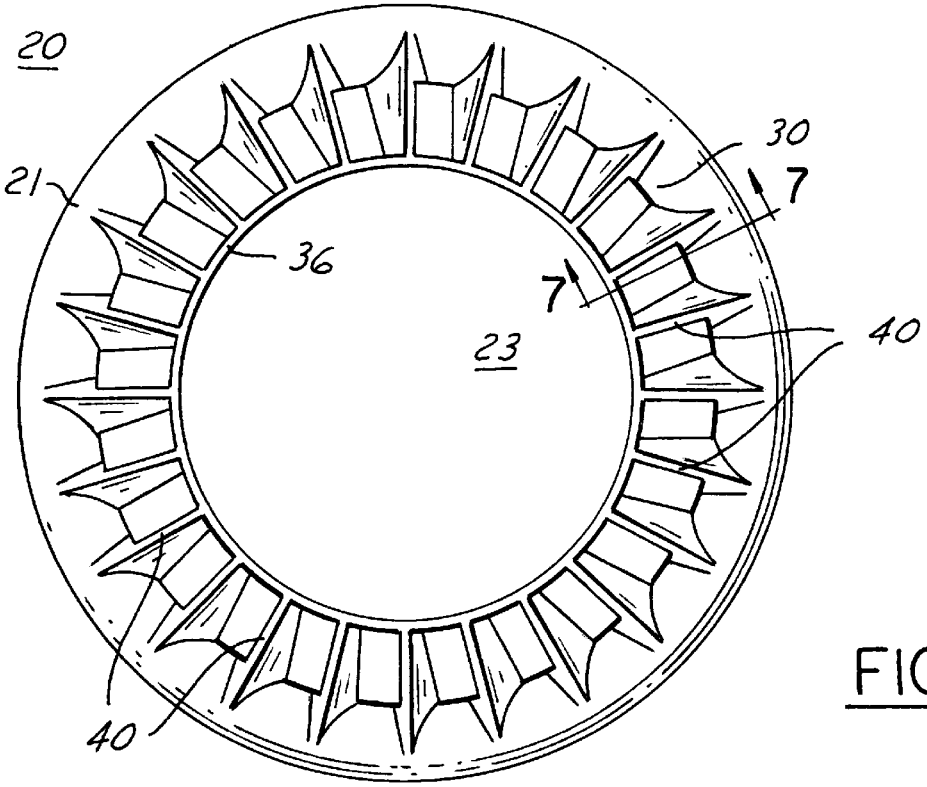
FIG. 4 is a top plan view of an air inlet opening having an air pre-swirler structured in accord with the principles of the present invention for rotating a volume of air entering a centrifugal blower assembly.

Referring now to FIG. 4, the pre-swirler 30 of the present invention will be described. The pre-swirler 30 is stationary in that the pre-swirler does not rotate relative to the inlet end of the inlet side 20 of the centrifugal blower assembly. Furthermore, none of the blades in the pre-swirler 30 move either; they are stationary as well. By fabricating the pre-swirler 30 to be stationary, the complexity of the mechanism is greatly reduced since the components necessary to move moveable vanes and the strategy for moving such vanes are not needed by a centrifugal blower of the present invention as is required in the prior art device such as disclosed in U.S. Pat. No. 3,781,127.

Figure 5:
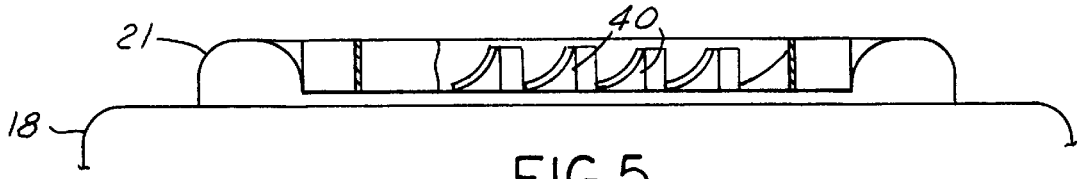
FIGS. 5, 6, 6A, 7, 8 and 9 are cross-sectional views taken along lines 5—5, 6—6, 7—7, 8—8 and 9—9, respectively, in FIGS. 4 and 5.
Figure 6:
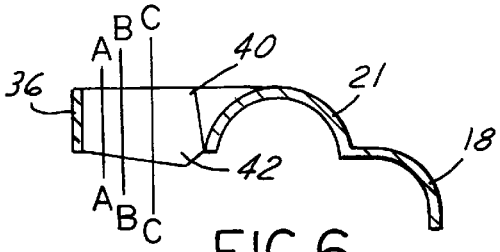

The pre-swirler 30 is a generally circular member molded into the inlet side 20 of the blower housing 18. The inlet side 20 includes an inlet ring 21 defining the inlet aperture 23. The pre-swirler 30 extends radially inwardly from the inlet ring 21. The pre-swirler includes an inner ring 36 having a diameter smaller than the diameter of the inlet ring and is disposed co-planar therewith. The inlet ring 21 and inner ring 36 each have an axial length of approximately equal size. The inlet ring 21 and inner ring 36 are spaced a predetermined radial distance apart. That distance is a function of the blower inlet area, that being: $\pi D^2/4$ where D is the diameter of the inlet ring. A plurality of stationary guide vanes 40 are disposed between the inner ring 36 and inlet ring 21. Each of the guide vanes 40 is disposed generally parallel to the axis of rotation of the fan wheel and generally are co-planar with the top of the inlet ring as shown in FIG. 5. The guide vanes are shown more clearly in FIGS. 5–9.

Figure 7:
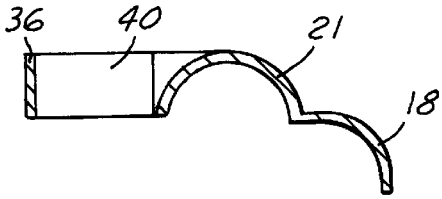
Figure 8:
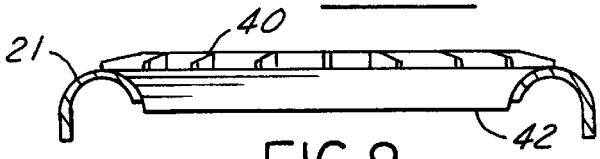
Figure 6A:
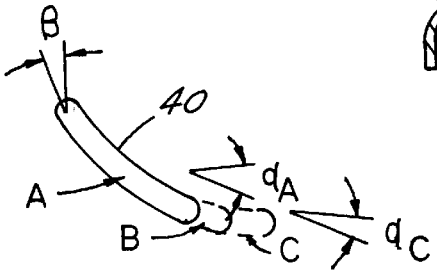

Each of the guide vanes 40 includes a constant inlet angle ($\beta$) of approximately five to ten degrees off the axial and a variable exit angle ($\alpha$) which changes along the vane from the inner ring 36 radially to the inlet ring 21. This exit angle is the angle at which the air leaves the guide vane immediately before entering the housing 18. Each guide vane 40 is configured such that the magnitude of the exit angle decreases gradually in a radial direction from the inner ring 36 to the inlet ring 21 as can be seen in FIG. 6A. FIG. 6A shows three different sections of a single guide vane (from FIG. 6) at A—A, B—B and C—C. The differences in the exit angles at these sections are shown in FIG. 6A, wherein the exit angles are decreasing gradually. This gradual decrease causes an increase in the radial velocity component of the air leaving the vanes such that the velocity of the air is high at the upper portion of the fan wheel, thus preventing inefficient rotation of the air within the housing as explained above. Furthermore, as shown more clearly in FIG. 6, each guide vane has an axial length. This length can exceed the axial length of the inlet ring, such that a portion 42 of the guide vane 40 extends below the inlet ring. This portion 42 directs the air leaving a vane into the upper portion of the fan wheel. This projection 42 disperses the air for longer distances along the fan blades and increases the effectiveness of the pre-swirler 30. Alternatively, as shown in FIG. 7, the axial length or height of the guide vanes 40 can be level with the height of the inlet ring 21. FIG. 8 shows yet another embodiment wherein guide vanes 40 project above and below the inlet ring 21. The vanes extending above the inlet ring 21 helps to capture and direct a volume of air between consecutive vanes. This is very effective in the assemblies with inlet duct configuration causing an air rotation in an opposite direction of the centrifugal blower fan rotation, where the pre-swirl will correct the air rotation direction before entering the fan, saving the fan energy that would otherwise be required to do this rotation correction.

Figure 9:
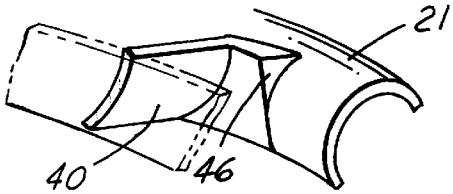

The pre-swirler 30 is fabricated integrally with the fabrication of the housing inlet side cover 20. The pre-swirler of the present invention can be injection molded from a variety of synthetic polymeric materials such as polypropylene, nylon, polyethylene and others known to those in the art. To release the injection mold, a flat 46 or curved surface extends upwards (or forward) with a draft angle of approximately three degrees as shown in FIG. 9. This flat 46 allows the mold to release and avoids sharp steel corners in the mold to prevent premature wear in the molds.

Figure 10:
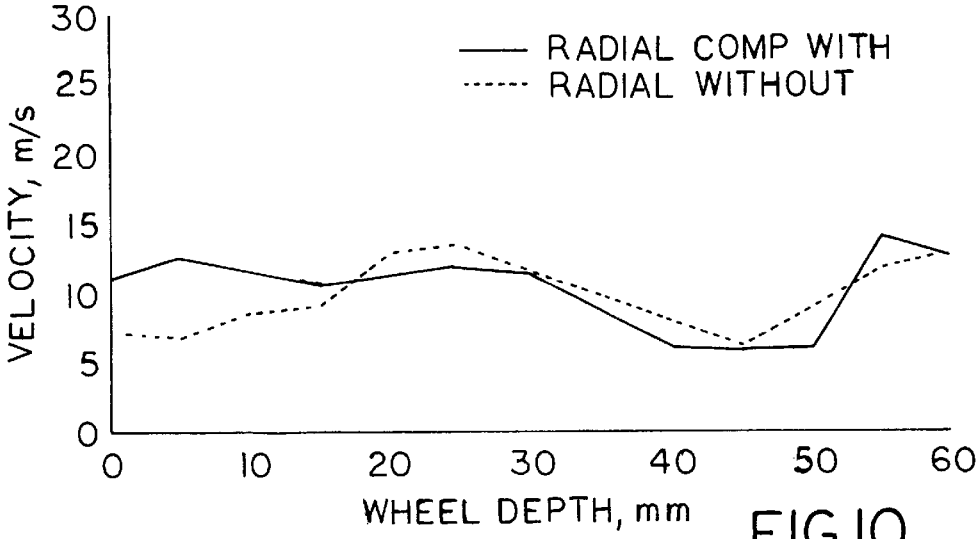
FIG. 10 is a graph of the radial velocity components outside a blower wheel along the wheel blades of a blower assembly without a pre-swirler and one with a pre-swirler.

FIG. 10 shows a comparison of a blower assembly without a pre-swirler (dotted line) and a blower assembly with a pre-swirler (solid line). The graph compares the radial velocity components outside the wheel and along the wheel blades (m/s) to fan wheel depth (mm). As shown up to a wheel depth of approximately 15 mm, the velocity of the air is higher for an assembly using a pre-swirler by an average of 1.5% to 5%.

Other modifications and permutations of the present invention will, no doubt, occur to those skilled in the art. For example, the number of blades, and the height and width of each blade is optimized for the blower system. High resistance HVAC systems require more control by a higher number of vanes and smaller distances between the vanes. The maximum width of the vanes must allow a projected distances sufficient for mold shut-off as described above. It is the following claims, including all equivalent, which define the scope of my invention.

What is claimed is:

1. A centrifugal blower assembly, comprising:

a fan wheel having a plurality of fan blades disposed between a fan ring and a fan hub;

a motor having a rotating shaft projecting therefrom and into engagement with said fan hub, said motor being operative to rotate said fan wheel about an axis coincident with the axis of said rotating shaft;

a housing for receiving said fan wheel and motor therein, said housing having an air inlet side, a motor receiving side opposite said air inlet side and a generally curved wall extending between the air inlet side and motor receiving side and thereby defining a chamber through which a volume of air passes, said air inlet side of said housing including:

a generally circular inlet ring having a predetermined axial length and defining an inlet aperture through which air is drawn by rotation of said fan wheel;

an generally circular inner ring disposed a predetermined distance radially inwardly from said inlet ring; and a plurality of stationary guide vanes disposed between said inner ring and said inlet ring generally parallel to the axis of rotation of said fan wheel, said plurality of guide vanes each having a predetermined axial length and including an inlet angle and a variable exit angle along a trailing edge of said guide vanes and wherein the axial length of each of said guide vanes is substantially equal to said axial length of said inlet ring.

2. A centrifugal blower assembly according to claim 1, wherein the axial length of each of said guide vanes is greater than said axial length of said inlet ring.

3. A centrifugal blower assembly according to claim 2, wherein the axial length of each of said guide vanes extends axially below said axial length of said inlet ring.

4. A centrifugal blower assembly according to claim 2, wherein the axial length of each of said guide vanes extends axially above said axial length of said inlet ring.

5. A centrifugal blower assembly according to claim 2, wherein the axial length of each of said guide vanes increases from said inner ring to said inlet ring.

6. A centrifugal blower assembly according to claim 1, wherein said plurality of guide vanes is operative to rotate a volume of air passing through said inlet aperture.

7. A centrifugal blower assembly according to claim 1, wherein said inlet angle of each of said guide vanes is constant and said exit angle of each of said guide vanes is greater at said inner ring than at said inlet ring.

8. A centrifugal blower assembly according to claim 1, wherein said exit angle of each of said guide vanes decreases in magnitude along a radial direction from said inner ring to said inlet ring.

9. A centrifugal blower assembly according to claim 1, wherein the number of guide vanes between said inlet ring and said inner ring is a prime number.

10. A centrifugal blower assembly according to claim 1, wherein said housing is manufactured from a synthetic polymeric material in an injection molding process.

11. A centrifugal blower assembly for an automotive vehicle, comprising:

a centrifugal fan wheel having a plurality of fan blades disposed between a fan ring and a fan hub;

a motor having a rotating shaft projecting therefrom and into engagement with said fan hub, said motor being operative to rotate said fan wheel about an axis coincident with the axis of said rotating shaft;

a housing for receiving said fan wheel and motor therein, said housing having an air inlet side, a motor receiving side opposite said air inlet side and a generally curved wall extending between the air inlet side and motor receiving side and thereby defining a chamber through which a volume of air passes, said air inlet side of said housing including:

a generally circular inlet ring having a predetermined axial length and defining an inlet aperture through which air is drawn by rotation of said fan wheel;

an generally circular inner ring disposed a predetermined distance radially inwardly from said inlet ring; and a plurality of stationary guide vanes disposed between said inner ring and said inlet ring generally parallel to the axis of rotation of said fan wheel, said plurality of guide vanes each having a predetermined axial length extending axially below said axial length of said inlet ring, and including a constant inlet angle and a variable exit angle along a trailing edge of said guide vanes.

12. A centrifugal blower assembly according to claim 11, wherein said exit angle of each of said guide vanes decreases in magnitude along a radial direction from said inner ring to said inlet ring, and causing a gradual increase in the air tangential velocity, moving more air towards the upper portion of the fan wheel vanes.

13. A centrifugal blower assembly according to claim 11, wherein each of said guide vanes in said plurality has a predetermined radial length, said radial length being a function of the area of said inlet aperture.

14. A centrifugal blower assembly according to claim 11, wherein said housing is manufactured from a synthetic polymeric material in an injection molding process.

15. An apparatus for imparting a rotation to a volume of air entering a centrifugal blower rotatable about an axis of rotation, comprising:

a generally circular inlet ring having a predetermined axial length and a predetermined diameter;

a generally circular inner ring having a diameter smaller than the diameter of said inlet ring and being disposed co-planar therewith and radially inwardly therefrom;

an annular region defined between said inlet ring and said inner ring; and a plurality of stationary guide vanes disposed between said inner ring and said inlet ring, said plurality of guide vanes each having a predetermined axial length extending axially below said axial length of said inlet ring, and including a constant inlet angle and a variable exit angle along a trailing edge of said guide vanes.

16. An apparatus according to claim 15, wherein said exit angle of each of said guide vanes decreases in magnitude along a radial direction from said inner ring to said inlet ring so as to cause a gradual increase in the tangential velocity of air from the inner ring to the inlet ring, moving more air in radial direction at the upper portion of the fan blades to a desired rate uniform with the rate flowing over the middle portion of the fan blades.

* * * * *